US006588334B2

(12) United States Patent
Salisbury

(10) Patent No.: US 6,588,334 B2
(45) Date of Patent: Jul. 8, 2003

(54) SCREEN PRINTING FRAME ASSEMBLY HAVING HOLLOW CONNECTORS WITH DRAIN HOLES

(76) Inventor: Ronald Salisbury, 1286 University Ave., #503, San Diego, CA (US) 92103

( * ) Notice: Subject to any disclaimer, the term of this patent is extended or adjusted under 35 U.S.C. 154(b) by 0 days.

(21) Appl. No.: 09/972,636

(22) Filed: Oct. 9, 2001

(65) Prior Publication Data

US 2003/0066442 A1 Apr. 10, 2003

(51) Int. Cl.[7] ..... B41L 13/00; B05C 17/08
(52) U.S. Cl. ..... 101/127.1; 160/381; 101/127
(58) Field of Search ..... 160/371–381; 101/127–128.4; 403/292–298; 52/656.9; 38/102.1

(56) References Cited

U.S. PATENT DOCUMENTS 2,545,277 A * 3/1951 Hannah et al. ..... 101/127.1
3,482,343 A * 12/1969 Hamu ..... 38/102.5
3,908,293 A * 9/1975 Newman ..... 101/127.1
4,105,348 A * 8/1978 Anderson et al. ..... 211/182
4,136,496 A * 1/1979 Molyneux ..... 403/295
4,452,138 A * 6/1984 Bubley et al. ..... 101/127.1
4,502,260 A * 3/1985 Machler ..... 160/369
5,003,741 A * 4/1991 Yeh ..... 52/280
5,224,799 A * 7/1993 Parker ..... 285/64
5,255,600 A * 10/1993 Hamu ..... 101/127.1
5,547,011 A * 8/1996 Dotson et al. ..... 160/371
5,802,971 A * 9/1998 Hamu et al. ..... 101/127.1
6,038,969 A * 3/2000 Podlipec et al. ..... 101/127

* cited by examiner

*Primary Examiner*—Leslie J. Evanisko
*Assistant Examiner*—Leo T. Hinze
(74) *Attorney, Agent, or Firm*—Steven W. Webb

(57) ABSTRACT

An improved screen printing frame connector is presented, the connector possessing flanges for easy insertion of frame side members and also providing large drainage holes to permit easy drying of the frame after washing.

4 Claims, 1 Drawing Sheet

SCREEN PRINTING FRAME ASSEMBLY HAVING HOLLOW CONNECTORS WITH DRAIN HOLES

BACKGROUND OF THE INVENTION

This invention relates to rectangular screen printing frames and in particular to an improvement in screen printing frame corner connectors.

Existing rectangular screen printing frames are intended to support the screen mesh while maintaining an even strain on on the screen at all points when the screen is having ink forced through it. Uneven screen tension causes uneven printing of the desired image. Hence, a rigid and strong frame is required to obtain the best results, requiring strong and lightweight components.

Typical screens are made out of extruded aluminum hollow tubing side members with rectangular cross-sections. The side members are connected at the corners by welding the ends of the side members together or by fastening them to connectors. Welding the frames together is expensive and requires relatively thicker metal in the side members, thereby increasing the weight of the screen. A lower cost approach is to make the corner connectors such that the side members slide into them fixedly and are then glued or fastened.

A recurring problem with screen printing frames is that they need to be washed with water regularly between uses. While aluminum does not absorb water, a pinhole in a weld will allow water into the hollow frame interior. Washed screens are then air dried. Regardless of how well the screens are dried, there is usually residual water left in the frame members or connectors, and the water will drip onto the substrate, mixing with the printing ink. Existing inventions do not address this problem.

The prior art discloses brackets as in U.S. Pat. No. 2,545,277, tensioners as in U.S. Pat. Nos. 3,908,293 and 6,038,969, screw adjusters as in U.S. Pat. Nos. 5,076,162, 5,802,971 and 5,255,600, and internal connectors with mitred ends U.S. Pat. No. 4,452,138.

None of these devices have drain holes nor do the provide a four-sided connection between the side members. U.S. Pat. No. 4,452,138 teaches a mitred, 45-degree angle two-side connection that has less strength than the present invention.

This invention differs from the above-listed devices by virtue of its low-cost manufacture, its ease of assembly with frame side members, and its self-drying capability. Note that this invention is not to be used with wooden screen frames, which are mitred at the corners.

BRIEF SUMMARY OF THE INVENTION

It is an object of this invention to provide a screen printing frame connector that is low-cost to manufacture.

It is an object of this invention to provide a screen printing frame connector that is strong and durable in use.

It is an object of this invention to provide a screen printing frame connector that facilitates the drying of the frame by means of strategically placed holes.

It is a further object of this invention to provide a screen printing connector that is four-sided instead of two-sided.

Further objects of this invention can be discerned by perusing the detailed description, drawings, specifications and claims of this application.

BRIEF DESCRIPTION OF THE DRAWINGS

The construction and operation of the invention can be readily appreciated from inspection of the drawings that accompany this application, combined with the detailed specification to follow.

DETAILED DESCRIPTION OF THE INVENTION

Figure 1:
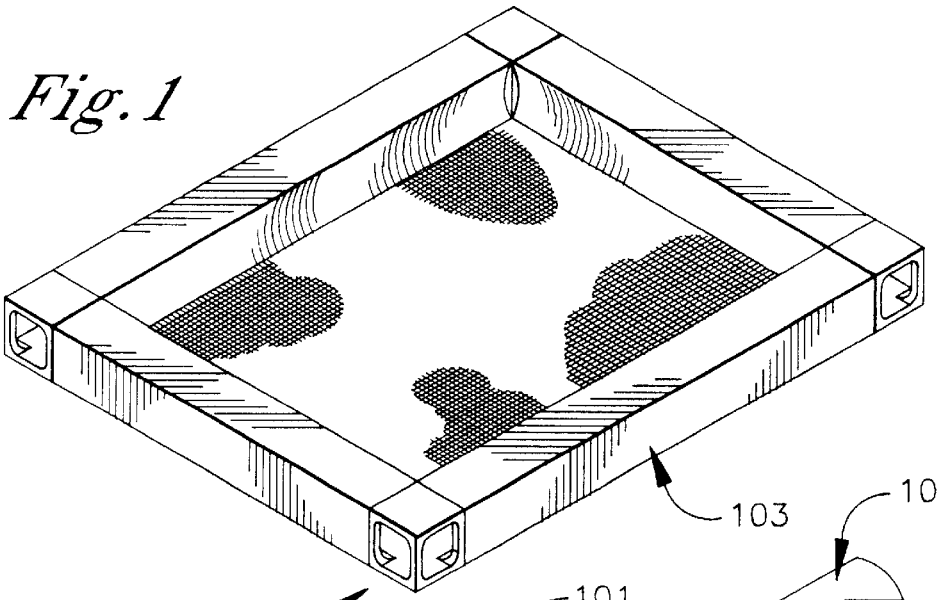
FIG. 1 is a perspective drawing of the preferred embodiment of the invention.
Figure 2:
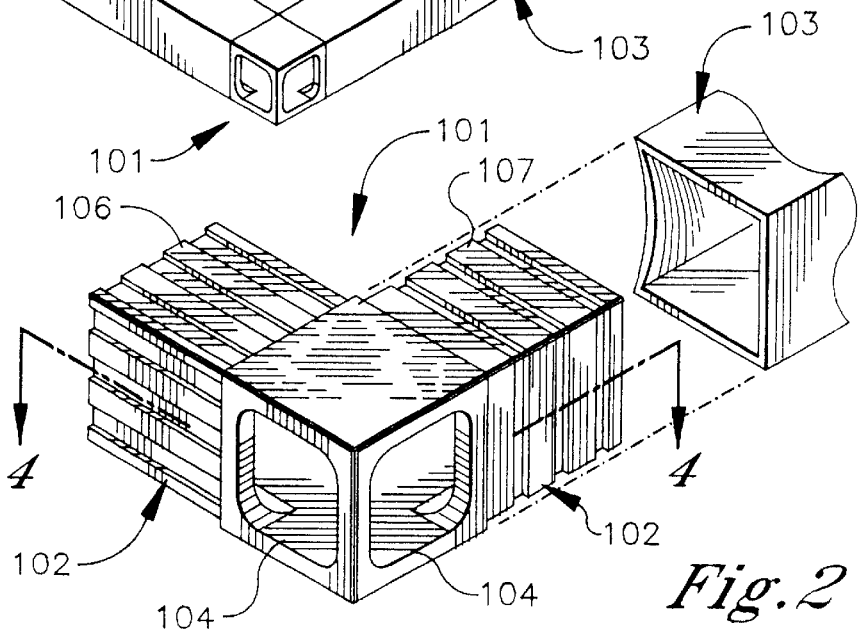
FIG. 2 is an exploded diagram showing how the frame mates with the connector.

The invention is best described by referring to the preferred embodiment illustrated in the drawings in FIG. 2.

Referring to FIG. 2, a screen printing frame connector (connector)[101] is a structure that resembles a tube with a rectangular cross-section bent at a right angle, made out of rigid material. The connector has a mating flange on each end [102] that is sized to accept the end of a side member of a screen printing frame [103]. The mating flange will have either a multiplicity of longitudinal ribs [106] or transverse ribs [107] as part of its structure. Since the invention is cast from plastic or soft metal, the ribs are molded into the body of the flange. The ribs are sheared away when the frame is mated to the flange, forming a water-tight seal.

Figure 3:
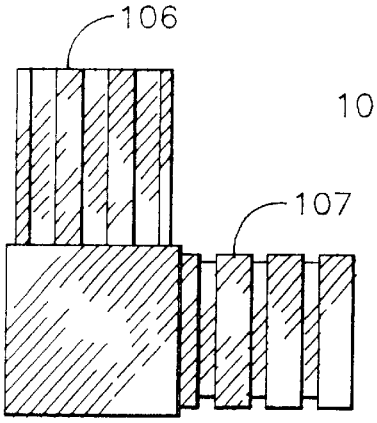
FIG. 3 is a top view of the invention.
Figure 4:
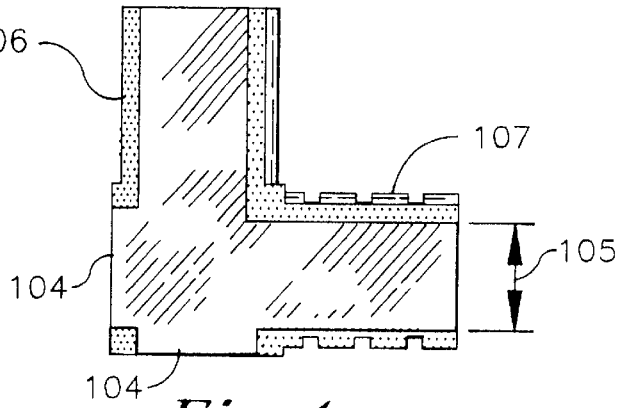
FIG. 4 is cross-section view of the invention.

The connector has two rectangularly-shaped holes in its sides, as shown in FIG. 2, to allow the drainage of water from the silk screen print frame [104]. The interior of the connector is hollow, as shown in FIG. 3, and the cross-section [105] is sufficiently large to allow the free passage of water from the frame [104] and to facilitate air-drying.

While the foregoing describes a preferred embodiment, variation on this design and equivalent designs may be resorted to in the scope and spirit of the claimed invention.

What is claimed is:

1. A screen printing frame assembly comprising at least one frame connector body, the frame connector body hollow and cubical in shape, the frame connector body possessing two connector sides, the connector sides at right angles to each other, the frame connector also possessing two drain hole sides, each connector side with a connector extension, each of the connector extensions extending out from the frame connector body as a hollow tube with square cross-section, each drain hole side possessing a rectangular-shaped hole, the outside width of the connector extension less than the width of the connector side, at least one frame side comprising a hollow tube of square cross section, the inside width of said frame side greater than the outside width of said connector extension said frame connector body connected fixedly to said frame side by means of inserting one of said connector extensions into one end of the frame side and fixedly attaching the connector body to the frame side, said at least one frame side and said at least one connector body capable of being assembled into a rectangular frame by means of sequentially attaching in a fixed manner four of said connector bodies and four of said frame sides, said drain hole sides thereby connected by means of said connector bodies to said frame sides and permitting the free flow of liquids from within said frame sides to the outside of the frame.

2. A screen printing frame connector as in claim 1, where the frame connector body and connector extensions are cast in one piece of material.

3. A screen printing frame connector as in claim 1, where the frame connector body and connector extensions are made out of plastic.

4. A screen printing frame connector as in claim 1, where the frame connector body and connector extensions are made out of aluminum.

* * * * *